United States Patent [19]

Sasso

[11] 4,416,453

[45] Nov. 22, 1983

[54] REGULAR SOLID MULTI-COLORED PUZZLE

[76] Inventor: Albert Sasso, 8 Rall Ct., Roseland, N.J. 07068

[21] Appl. No.: 387,921

[22] Filed: Jun. 14, 1982

[51] Int. Cl.[3] ..... A63F 9/08

[52] U.S. Cl. ..... 273/155; 273/153 S

[58] Field of Search ..... 273/153 S, 155, 294

[56] References Cited

U.S. PATENT DOCUMENTS

| | | | |
|---|---|---|---|
| 3,608,906 | 9/1971 | Odier | 273/294 |
| 3,690,672 | 9/1972 | Dreyer | 273/155 |
| 3,750,307 | 8/1973 | Phillips et al. | 434/174 |

FOREIGN PATENT DOCUMENTS

| | | | |
|---|---|---|---|
| 8104382 | 7/1981 | Fed. Rep. of Germany | 273/153 S |
| 188215 | 11/1922 | United Kingdom | 273/155 |

*Primary Examiner*—Anton O. Oechsle

*Attorney, Agent, or Firm*—Anthony F. Cuoco

[57] ABSTRACT

A puzzle in the form of a multi-colored regular solid is disclosed. Plates corresponding to the adjacent faces of the regular solid are disposed on said faces and divided into a plurality of triangles of different colors, and which triangles have adjacent edges. The plates are coupled in pairs and the pairs are rotatable relative to their respective faces. The object of the puzzle is to rotate the pairs of plates so that none of the adjacent edges of the triangles are of the same color.

11 Claims, 18 Drawing Figures

REGULAR SOLID MULTI-COLORED PUZZLE

BACKGROUND OF THE INVENTION

With reference to the textbook *Engineering Drawing* by Thomas E. French, published by McGraw-Hill Book Company, Inc. New York, N.Y., Sixth Edition, 1941, page 76, the five regular solids are defined as: a tetrahedron having four triangular faces; a hexahedron having six square faces; an octahedron having eight triangular faces; a dodecahedron having twelve pentagonal faces; and an icosahedron having twenty triangular faces.

Each of the faces may be divided into triangles. Thus, the triangular faces of the tetrahedron, the octahedron and the icosahedron may be divided into three triangles; the square faces of the hexahedron may be divided into four triangles; and the pentagonal faces of the dodecahedron may be divided into five triangles. Each of the triangles may be of a different color.

For example, the dodecahedron may be divided into sixty triangles, i.e. five triangles for each of the twelve faces. Each of the five triangles is of a different color and has edges adjacent edges of triangles on adjacent faces. For the dodecahedron there are thirty such adjacent edges.

Likewise, the icosahedron may be divided into sixty triangles, i.e. three triangles for each of the twenty faces. Each of the three triangles is of a different color and has edges adjacent edges of triangles on adjacent faces. For the icosahedron there are also thirty such adjacent edges.

The faces of the other regular solids may likewise be divided into triangles of different colors, with triangles on adjacent faces having adjacent edges.

The present invention features a regular solid in a unique structural configuration which provides an innovative puzzle having a discrete solution, whereby none of the adjacent edges of the triangles are of the same color.

SUMMARY OF THE INVENTION

This invention contemplates a multi-colored puzzle including a hollow, regular solid base and a plurality of plates corresponding in number and size to the adjacent faces of the regular solid base. The plates are disposed on the faces and coupled internal to the base in pairs so that the pairs of plates are rotatable relative to the respective faces. The plates are divided into triangles of different colors, with the triangles having edges adjacent edges of triangles on adjacent plates. Each plate has triangles of the same number and color, but with the relative positions of triangles of a particular color varying on each plate. The colored triangles are disposed on the plates in a predetermined order and the plates are rotated in pairs until a discrete solution to the puzzle is achieved, whereby all of the adjacent edges of the triangles are of different colors.

DETAILED DESCRIPTION OF THE INVENTION

Figure 1:
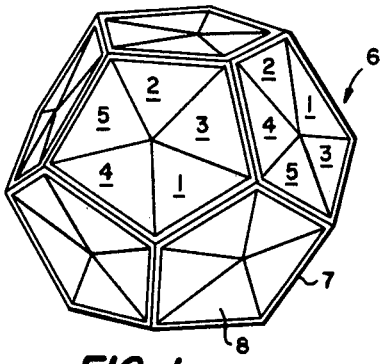
FIG. 1 is a diagrammatic representation of a dodecahedron illustrating the principle of the invention.
Figure 2:
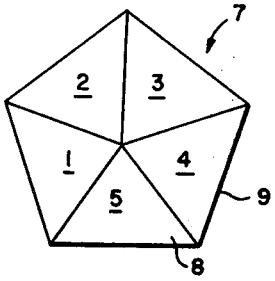
FIG. 2 is a diagrammatic representation showing a face of the dodecahedron of FIG. 1, and further illustrating the principle of the invention.

The principle of the invention will first be described with reference to FIGS. 1 and 2, which show a dodecahedron 6 having twelve regular pentagonal faces such as 7. Each face 7 is divided into five triangles such as 8, for a total of sixty triangles for all twelve faces. Each face 7 meets five other faces 7 on adjacent edges such as 9 (FIG. 2) of its five sided pentagonal shape. Dodecahedron 6 has thirty such adjacent edges where the twelve faces meet each other. Due to the three dimensional symmetry of dodecahedron 6, there are six pairs of opposite faces 7 which provide twelve adjacent faces of the dodecahedron.

Each of the five triangles 8 of a pentagonal face 7 is of a different color so that the respective edges 9 of the triangle are of different colors. Thus, the triangles may be colored red, white, blue, yellow and green, said colors being designated by the numerals 1, 2, 3, 4, and 5 respectively, as shown in FIG. 2. The triangles on each of the faces 7 are so colored, but the relative positions of the colors vary is indicated by the numerical designations 1, 2, 3, 4, and 5, as shown for illustrative purposes in FIG. 1.

With the aforegoing in mind, a structural implementation of the invention will be described with reference to FIGS. 3–12.

Figure 3:
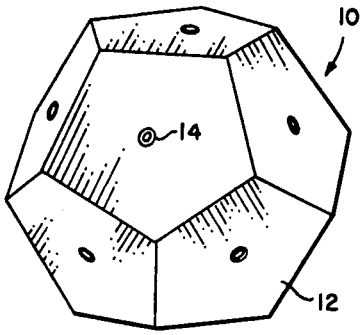
FIG. 3 is a diagrammatic representation of a dodecahedron base used in a structural implementation of the invention.
Figure 4:
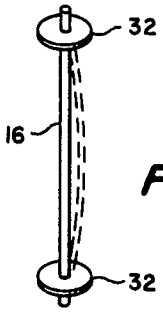
FIG. 4 is a diagrammatic representation illustrating a flexible shaft used for rotatably coupling pairs of plates corresponding to the adjacent faces of the base shown in FIG. 3.

A hollow plastic, regular pentagonal dodecahedron base 10 forms the rigid structure of the invention. Each of the twelve faces 12 of base 10 has a through hole 14 at its center (FIG. 3).

Holes 14 are large enough to allow a flexible plastic shaft 16 (FIG. 4) to pass through the holes and to rotate frcely without excessive lateral movement of the shaft. The flexible characteristic of shaft 16 is indicated in phantom in FIG. 4.

Since dodecahedron base 10 is composed of six pairs of symmetrically arranged opposite pentagonal faces 12, six flexible plastic shafts 16 are positioned so that their ends pass through holes 14 in the twelve opposite faces 12. The bodies of the shafts, due to the three dimensional symmetry of dodecahedron base 10, meet within the center of the hollow base. Due to the flexible characteristic of the shafts, they are deflected away from each other, allowing rotation of each shaft without interference with the others. Three shafts 16 are shown so arranged in FIG. 5 for illustrating this feature of the invention.

Figure 8:
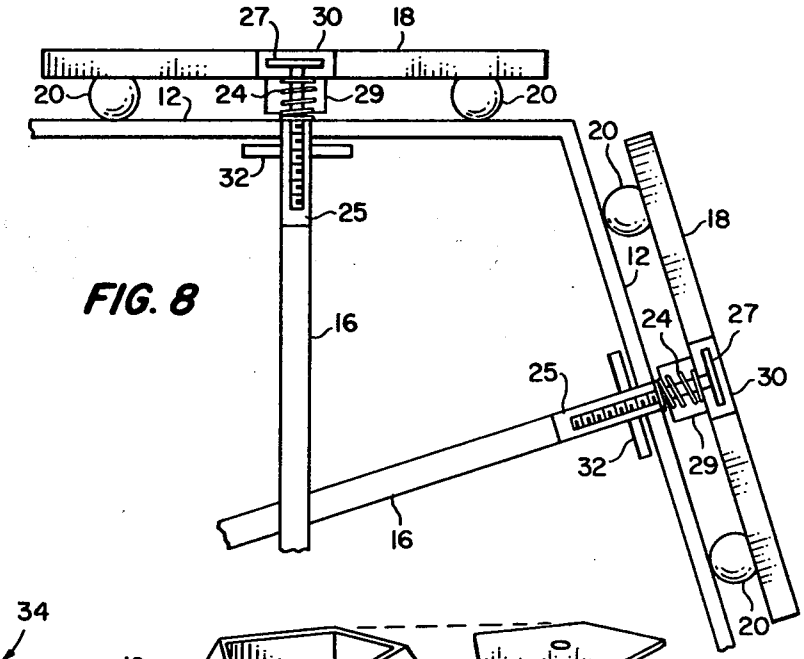
FIGS. 8 and 9 are diagrammatic representations illustrating the coupling of the plates shown in FIGS. 6 and 7 to the shafts shown in FIG. 4, whereby said plates are rotatable in pairs relative to the respective faces of the base shown in FIG. 3.

Plastic regular pentagonal plates 18 (FIGS. 6 and 7) corresponding in size to faces 12, are connected to each of the twelve ends of the shafts outside dodecahedron base 10. The pentagonal plates are separated from the outside surface of the hollow dodecahedron base by ball-shaped spacers 20, are are not interconnected with adjacent pentagonal plates (FIG. 8). Ball-shaped spacers 20 separate the plates from the dodecahedron base, while providing stability and allowing freedom of rotation as will be hereinafter seen.

Figure 6:
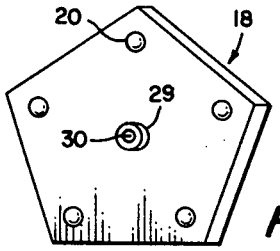
FIGS. 6 and 7 are diagrammatic representations illustrating the configuration of plates corresponding to the faces of the base shown in FIG. 3.
Figure 7:
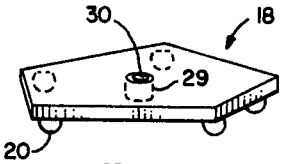
Figure 9:
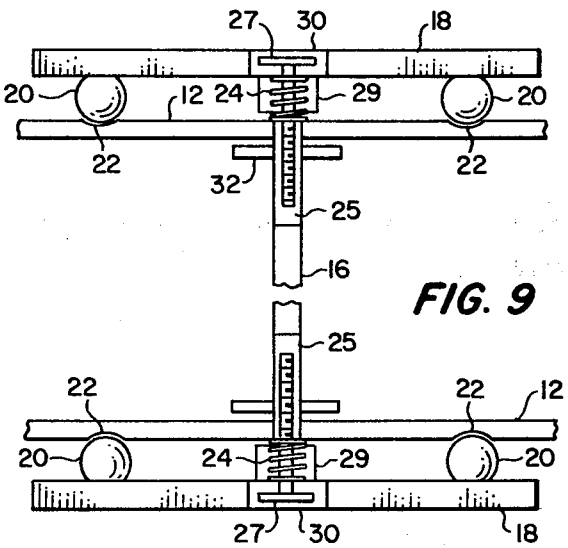

Each plate 18 has five spacers 20 (one at each of its corners as shown in FIG. 6) which normally rest in five corresponding depressions or detents 22 in the outside surfaces of faces 12 of base 10 (FIG. 9). This arrangement prevents random movement of plates 18 unless a sufficient turning or rotating force is applied to the plates by a user.

When such a rotating force is applied, the balls exit the detents and a spring 24 is compressed, whereby the plates are turned until the next set of detents 22 is reached. Spacers 20 are thereupon biased by spring 24 to engage the detents to again secure the plate from random movement. Detents 22 also serve to align plates 18 in the proper position so that they will not interfere with the movement of adjacent plates as will now be seen with reference to FIGS. 8 and 9.

Figure 5:
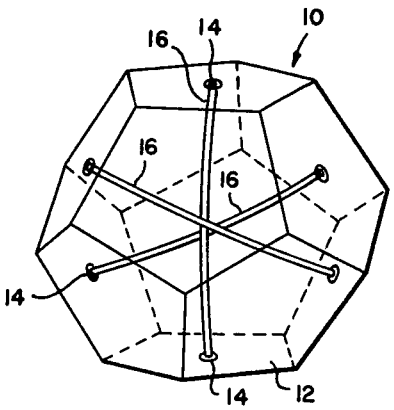
Figure 10:
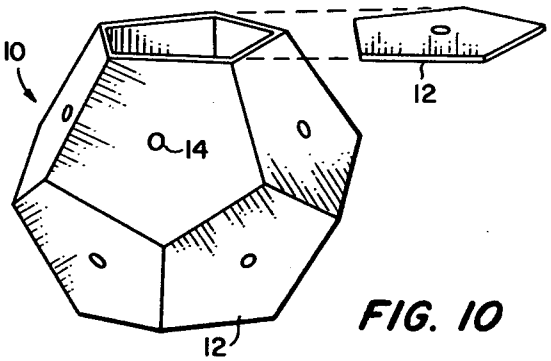
FIG. 10 is a diagrammatic representation showing the construction of the base illustrated in FIG. 3, for the purposes of fabricating the invention.

In fabricating the invention, hollow dodecahedron base 10 is constructed with one face 12 missing as shown in FIG. 10 so that access is had to the interior of the base. Five of the six flexible plastic shafts 16 are positioned with their ends in holes 14 in pairs of faces such as opposite faces 12 (FIG. 5). The remaining shaft 16 is placed in the hole 14 of the face opposite the missing face 12. Then the free end of this shaft is placed in the hole of the omitted face as this face is positioned into place and suitably secured on base 10 to complete the dodecahedron configuration.

Figure 11:
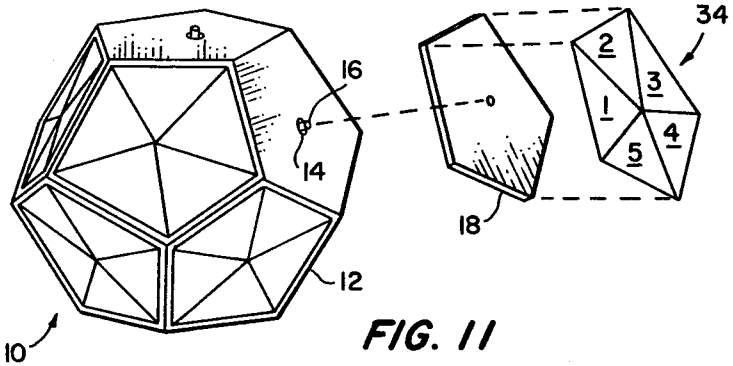
FIG. 11 is an exploded diagrammatic representation generally illustrating the structural relationship between the rotatable plates and the faces of the regular solid, and the rendering of said plates into colored triangles.

Thus, the six shafts 16 are disposed within base 10 with their ends extending beyond the surface of base 10 from corresponding faces 12 (FIG. 11). As shown in FIGS. 8 and 9, the shaft ends have a threaded hole 25 which accepts a screw 27. Plates 18 have downwardly extending hubs 29 which receive the shaft ends surrounded by springs 24. Holes 30 (FIGS. 6, 7) extend through plates 18 and the associated hubs 29. Screws 28 are inserted in holes 30 and engage threaded holes 25 in the ends of shafts 16, thereby coupling plates 18 to the respective shafts so that pairs of opposite plates 18 are rotatable relative to the respective faces of base 10. Screws 27 are tightened just enough to hold the plates securely to the shafts, while allowing some movement of the plate away from and toward springs 24. Spacers 32 are coupled to both ends of shafts 16 (FIGS. 4, 8, 9) and permit restricted longitudinal movement of shafts 16 having plates 18 coupled thereto as aforenoted.

Plastic decals 34 divided into the previously described colored triangles are applied to plates 18 after the plates have been coupled to the shafts (FIG. 11). The decals cover the screw holes (the screw heads are beneath the surface of the plates which may be countersunk) and are applied in a predetermined order to assure a discrete solution to the puzzle being described.

The arrangement of dodecahedron base 10 combined with the rotatably coupled, preferably opposite, pairs of plates 18 via shafts 16 (FIG. 9), along with the division of the plates into five triangles of different colors and the arrangement of the colored triangles in a predetermined order on the plates, gives the puzzle its unique characteristics. Thus, there exists only one position of all twelve plates 18 such that all adjacent edges of the triangles are of different colors. That is to say, the solution of the puzzle is reduced to finding the one position of the twelve plates 18 in which all triangles meeting at the thirty adjacent edges of the dodecahedron are of different colors. It is obvious that there are a large number of incorrect positions, which makes finding the correct solution a challenge and imparts the desired characteristics to the puzzle.

To solve the puzzle, a plate 18 is grasped by the user and rotated with its paired plate via a shaft 16 at random until a mix of positions of colored triangles occurs. The plates are thereafter rotated in pairs until none of the adjacent edges of the triangles are of the same color.

Figure 12:
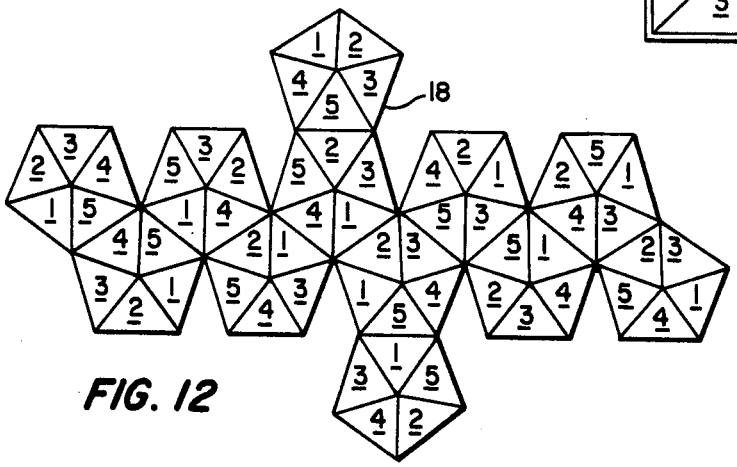
FIG. 12 is a diagrammatic representation showing a particular order of colored triangles, whereby a discrete solution to the dodecahedron puzzle of the invention is provided.

The discrete solution occurs if the colored triangles are disposed on plates 18 in a predetermined order such as illustrated in FIG. 12, which represents the relative positions of plates 18 if the three dimension dodecahedron base configuration is opened into a two dimensional plane figure. By placing the colored triangles in the indicated positions, with the numerals 1–5 representing the particular colors as aforenoted, the discrete solution to the puzzle is assured.

Figure 15:
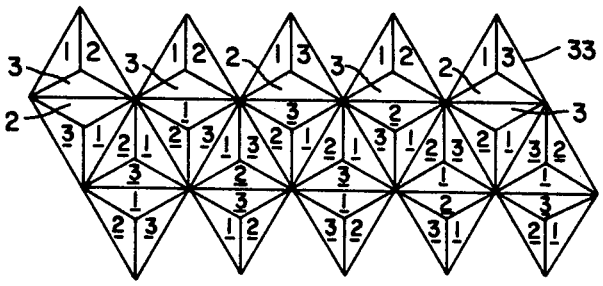
FIG. 15 is a diagrammatic representation showing a particular order of colored triangles as applied to the icosahedron of FIG. 13, whereby a discrete solution to the puzzle of the invention is provided.
Figure 14:
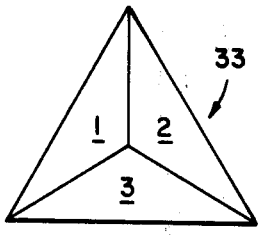
FIGS. 13 and 14 are diagrammatic representations of an icosahedron illustrating the principle of the invention.
Figure 13:
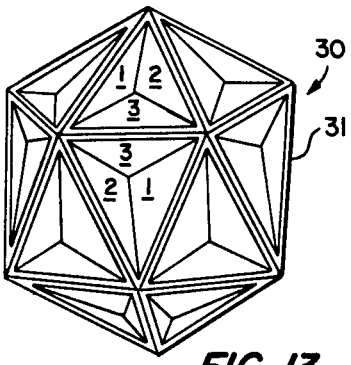

Although the invention has been described with reference to a dodecahedron an analogous puzzle with an analogous structure, operation and solution can be constructed using the other regular solids. For example, an icosahedron configuration 30 having twenty faces and thirty adjacent edges is shown in FIG. 13. Each face of the icosahedron is a (equilateral) triangle and has a plate 33 associated therewith which is divided into three smaller triangles of different colors such as red (1), white (2) and blue (3) as shown in FIG. 14. The arrangement of colors on the triangular plates in the order indicated in FIG. 15, for example, will assure a discrete solution to the puzzle.

In the case of an icosahedron, ten pairs of preferably opposite plates 32 are connected with ten shafts in a manner as heretofore described. Rotation of the plates in pairs to align the plates so that all pairs of triangles at the thirty adjacent edges are of different colors is required to solve the puzzle. The number of plates and triangular edges produces many combinations, and the complexity of the puzzle is approximate to that of the dodecahedron configuration and also provides a challenge to the user.

The dodecahefron and icosahedron are the two regular solids preferably used for the puzzle described due to the challenge presented as aforenoted, although the remaining regular solids can be used in analogous structures as analogous puzzles.

Figure 16:
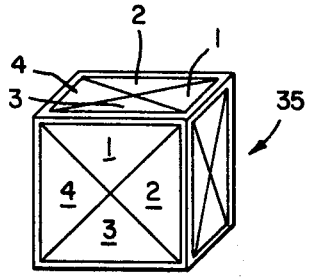
FIG. 16 is a diagrammatic representation of a hexahedron illustrating the principle of the invention.
Figure 17:
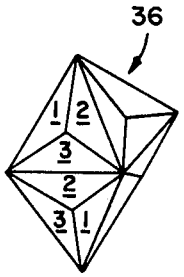
FIG. 17 is a diagrammatic representation of an octahedron illustrating the principle of the invention.
Figure 18:
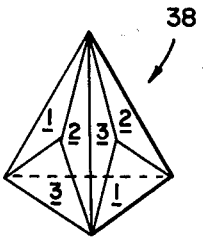
FIG. 18 is a diagrammatic representation of a tetrahedron illustrating the principle of the invention.

Hexahedron 35 (FIG. 16) and octahedron 36 (FIG. 17) offer fewer possible combinations and hence a less challenging solution, as also does tetrahedron 38 (FIG. 18), although these solids may be used in analogous puzzles for those requiring a less challenging solution, as the case may be.

Although the puzzle of the invention has been described as preferably coupling opposite plates on opposite faces in rotatable pairs, the flexible characteristics of shafts 16 does not make this a necessity. This is an important feature in the case of a tetrahedron where there are no two faces and hence plates directly opposite each other, but which plates may nevertheless be coupled in pairs via flexible shafts 16 to provide a puzzle according to the invention.

Having thus described the invention, what is claimed is:

1. A multi-colored puzzle, comprising:

a hollow, regular solid base;

a plurality of plates corresponding in number, size and shape to the faces of the regular solid base, and disposed on corresponding faces of the base;

means for coupling the plates in pairs, whereby the pairs of plates are rotatable relative to corresponding faces of the bsase;

the plates being divided into a plurality of triangles, with each plate having the same number of triangles and the triangles on any one plate having edges adjacent the edges of the triangles on adjacent plates;

the triangles being of different colors, and each plate having triangles of the same colors with the relative positions of triangles of a particular color varying in a predetermined order; and the plates being rotated by a user of the puzzle in pairs relative to the corresponding faces until a discrete solution to the puzzle is achieved, whereby all of the adjacent edges of the triangles are of different colors.

2. A multi-colored puzzle as described by claim 1, whereby the means for coupling the plates in pairs, whereby the pairs of plates are rotatable includes:

a plurality of shafts corresponding in number to one-half the number of faces and disposed within the base;

each of the shafts having one end extending through one of the faces and an opposite end extending through another of the faces so that the shafts are rotatable relative to said faces; and means for coupling a plate to the one shaft end and a plate to the opposite shaft end so that a pair of plates is coupled to each of the shafts, with said pairs of plates rotatable with the respective shaft relative to the corresponding faces of the base.

3. A multi-colored puzzle as described by claim 2, wherein the means for coupling a plate to the one shaft end and a plate to the opposite shaft end includes;

resilient means arranged with each of the plates; and means arranged with the plates and their respective shaft ends for securing the plates to the shaft and for biasing the resilient means so that the plates are normally maintained disposed on their corresponding faces, with the colored triangles on said plates being in a selected position.

4. A multi-colored puzzle as described by claim 3, including:

a plurality of spacers carried by the plates;

a corresponding plurality of detents arranged on the corresponding faces for engaging the spacers to normally maintain the plates disposed on the faces and to prevent random movement of the plates so that the colored triangles remain in the selected position when the plates are secured to the shaft and the resilient means is biased.

5. A multi-colored puzzle as described by claim 4, wherein:

a force is exerted by the user on one of the plates for rotating said plate and the other plate in its coupled pair relative to the corresponding faces, whereupon the spacers leave the detent and the plates are rotated so that the colored triangles are in another position, with the detends thereupon re-engaging the spacers.

6. A multi-colored puzzle as described by claim 2, wherein:

each of the plurality of shafts disposed within the base is flexible for avoiding interference with the other shafts and for being freely rotatable relative thereto.

7. A multi-colored puzzle as described by claim 1, wherein:

the hollow regular solid base is a dodecahedeon having pentagonal faces;

the plates are pentagonal plates; and the pentagonal plates are divided into five triangles of different colors.

8. A multi-colored puzzle as described by claim 1, wherein:

the hollow regular solid base is an icosahedeon having triangular faces;

the plates are triangular plates; and the triangular plates are divided into three triangles of different colors.

9. A multi-colored puzzle comprising:

a hollow regular solid base;

a plurality of plates corresponding in number, size and shape to the faces of the regular solid base;

a plurality of shafts rotatably disposed within the base, each of which shafts is flexible to avoid interferring with the other shafts within the base, and has each of its ends extending through a face;

means for coupling a plate to each of the extending ends of each of the shafts so that plates are rotatable in pairs relative to corresponding faces of the base and are disposed in selected positions on the corresponding faces;

means arranged with the plates and the faces for maintaining the plates in the selected positions;

the plates being divided into a plurality of triangles, with each plate having the same number of triangles and the triangles on any one plate having edges adjacent the edges of triangles on adjacent plates;

the triangles being of different colors, and each plate having triangles of the same colors, with the relative positions of the triangles of a particular color varying in a predetermined order;

and the plates being rotated by a user of the puzzle in pairs relative to the corresponding faces to selected positions until a discrete solution to the puzzle is achieved, whereby all of the adjacent edges of the triangles are of different colors.

10. A multi-colored puzzle as described by claim 9, wherein the means arranged with the plates and the faces for maintaining the plates in the selected positions includes;

the plates having a plurality of ball spacers;

the faces having a corresponding plurality of detents which engage the ball spacers; and the resilient means operative to retain the detents and ball spacers in engagement.

11. A multi-colored puzzle as described by claim 10, wherein:

a force is exerted by a user of the puzzle on the plates to rotate said plates from a first selected position to a second selected position, whereupon the operative effect of the resilient means is overcome and the detents and spacers are disengaged until the second selected position is reached and said detents and spacers are re-engaged.

* * * * *